United States Patent [19]

Speicher

[11] Patent Number: 4,487,032

[45] Date of Patent: Dec. 11, 1984

[54] ENERGY CONSERVATION FOR HOUSEHOLD REFRIGERATORS AND WATER HEATERS

[76] Inventor: Terry L. Speicher, 2262 King James Ct., Winter Park, Fla. 32792

[21] Appl. No.: 481,254

[22] Filed: Apr. 1, 1983

[51] Int. Cl.[3] ..... F25B 39/04

[52] U.S. Cl. ..... 62/183; 62/238.6

[58] Field of Search ..... 62/238.6, 238.7, 183, 62/184, 181; 165/DIG. 2, DIG. 23

[56] References Cited

U.S. PATENT DOCUMENTS

| | | | |
|---|---|---|---|
| 2,125,842 | 8/1938 | Eggleston | 62/183 X |
| 3,188,829 | 6/1965 | Siewert et al. | 62/183 X |
| 4,241,588 | 12/1980 | Murphy et al. | 165/DIG. 2 |
| 4,246,764 | 1/1981 | Papadakos | 62/183 |
| 4,293,093 | 10/1981 | Raymond et al. | 237/19 |
| 4,373,345 | 2/1983 | Tyree, Jr. et al. | 62/183 X |

FOREIGN PATENT DOCUMENTS

| | | | |
|---|---|---|---|
| 2052712 | 12/1980 | United Kingdom | 62/238.7 |

*Primary Examiner*—Harry Tanner

*Attorney, Agent, or Firm*—Young & Thompson

[57] ABSTRACT

An energy conservation arrangement for household refrigerators and water heaters, in which the source of cold water to the hot water heater is divided and part is caused to flow through and be warmed in the condenser of the refrigerator. The warmed water is then further heated in the oil cooling loop of the refrigerator compressor, and proceeds then to the top of the hot water tank.

7 Claims, 4 Drawing Figures

FIG. 1 PRIOR ART
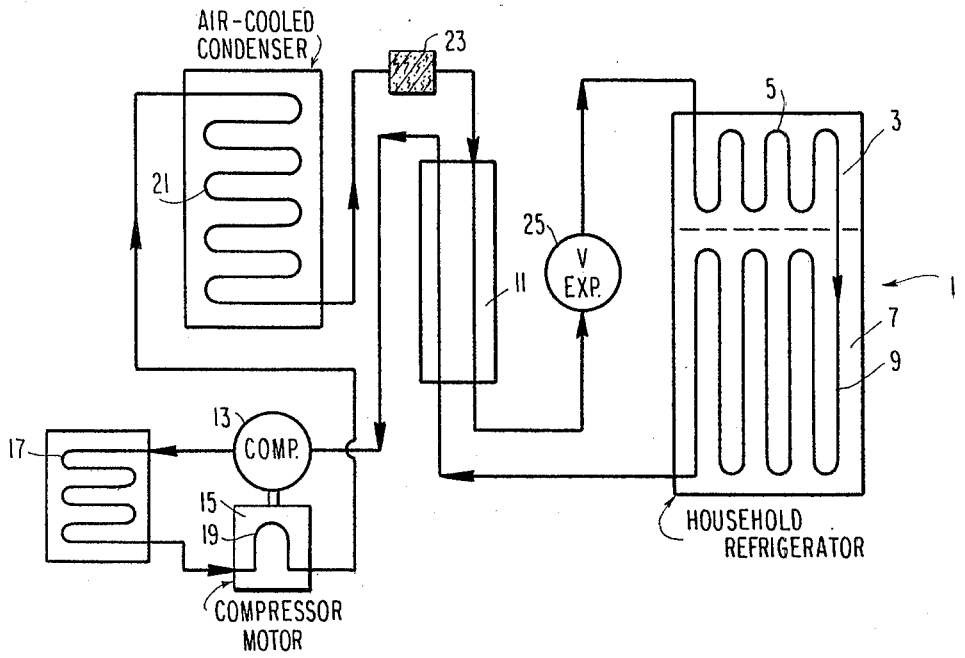
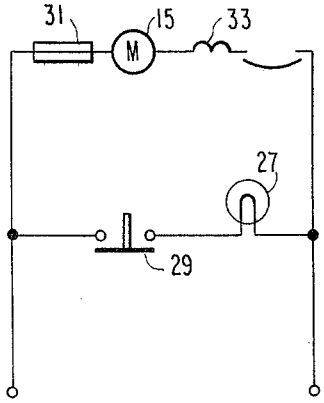
FIG. 2 PRIOR ART
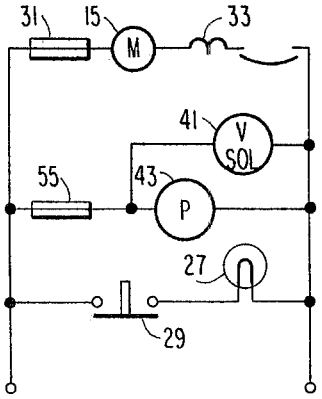
FIG. 4

ENERGY CONSERVATION FOR HOUSEHOLD REFRIGERATORS AND WATER HEATERS

The present invention relates to means for conserving energy in the use of household refrigerators and water heaters.

BACKGROUND OF THE INVENTION

As is well known, household refrigerators (and here the term "refrigerators" is intended to include refrigerators with or without a freezing compartment, as well as freezers of either the upright or chest type) employ a closed-cycle expansion-compression refrigeration cycle, in which heat is abstracted from the interior of the refrigerator by a refrigerant in liquid phase and at low pressure, to vaporize the refrigerant, and the vaporized refrigerant is then compressed and cooled prior to reliquefaction upon expansion.

In household refrigerators, the cooling of the compressed gaseous refrigerant is effected in an air-cooled condenser. This is wasteful of energy, particularly when air conditioning units are in use for cooling the home. Moreover, the air-cooled condenser coils tend to become covered with dust and to lose efficiency and must be periodically cleaned. Still further, the interior space of the refrigerator is reduced by the need to provide thicker walls and greater insulation, so as to reduce the load on the condenser and hence to reduce the loss of energy at the condenser. Still further, a highly efficient compressor motor must be used in such a system, and this raises the initial cost of the refrigerator.

It is also well known that household water heaters are heated by an external energy source, e.g. natural gas or electricity. These heaters are ordinarily in the form of an upright vertically elongated tank. The water in the tank is ordinarily characterized by a high degree of stratification: that is, the water at the top will be relatively hot and that at the bottom will be relatively cold, and so there will be a sharp temperature gradient from top to bottom in the tank. The cold water supply is introduced into the bottom of the tank and hot water for use is removed from the top of the tank. Often, however, the supply of hot water is insufficient, as the heating means for the water in the tank can heat to an acceptable temperature level only a certain quantity of water per unit time.

It is also known that, in a household, peak demand for refrigeration usually precedes by a predetermined amount of time, the peak demand for hot water. For example, the household refrigerator door is frequently open and the heat ingress to the refrigerator is greatest, during the preparation of a meal. Immediately following the meal, however, the demand for hot water may rise to its peak, as the dishes are washed. Thus, maximum energy loss via the household refrigerator ordinarily precedes maximum energy loss via the household hot water heater.

Finally, it is known that in most household refrigerators, the compressor is operating about 80% of the time; whilst household hot water heaters are obliged to cycle on every so often, to replace heat lost to the ambient through the insulation.

OBJECTS OF THE INVENTION

Accordingly, it is an object of the present invention to conserve energy both with respect to the household refrigerator and with respect to the household hot water heater.

Another object of the present invention is the provision of an energy conservation system which recovers energy from a household refrigerator during a period of peak usage of the refrigerator, and transfers that energy to the household hot water heater in time for a subsequent peak expenditure of energy from the latter.

It is also an object of this invention greatly to reduce or even to eliminate the cycling on of a household hot water heater that was heretofore necessary in order to replace heat lost to the ambient through the insulation.

Finally, it is an object of the present invention to provide an energy conservation system which will be simple and inexpensive to manufacture, easy to install, automatic in operation, and rugged and durable in use.

SUMMARY OF THE INVENTION

Briefly, the present invention achieves these objects, by replacing the conventional air-cooled condenser of a conventional household refrigerator, with a water-cooled condenser through which passes water which will subsequently be stored in the household hot water heater. The water from the condenser then passes through the conventional oil-cooling loop of the compressor motor, which, according to the prior art, had been cooled by compressed refrigerant. This twice-heated water is then introduced into the household hot water heater, not through the cold water inlet, but rather through the hot-water outlet thereof. The refrigerant outlet of the water-cooled condenser is monitored as to temperature; and when this temperature rises to a suitable predetermined value, then a solenoid valve is opened to admit cold water from a cold water source, to the cold end of the condenser past a check valve and under the impetus of a pump.

BRIEF DESCRIPTION OF THE DRAWINGS

These and other objects, features and advantages of the present invention will become apparent from a consideration of the following description, taken in connection with the accompanying drawings, in which:

FIG. 1 is a fluid circuit diagram of a conventional household refrigerator according to the prior art;

FIG. 2 is a simplified electrical circuit diagram of the prior art household refrigerator of FIG. 1;

FIG. 4 is a simplfiied electrical circuit diagram of the system of FIG. 3.

Figure 3:
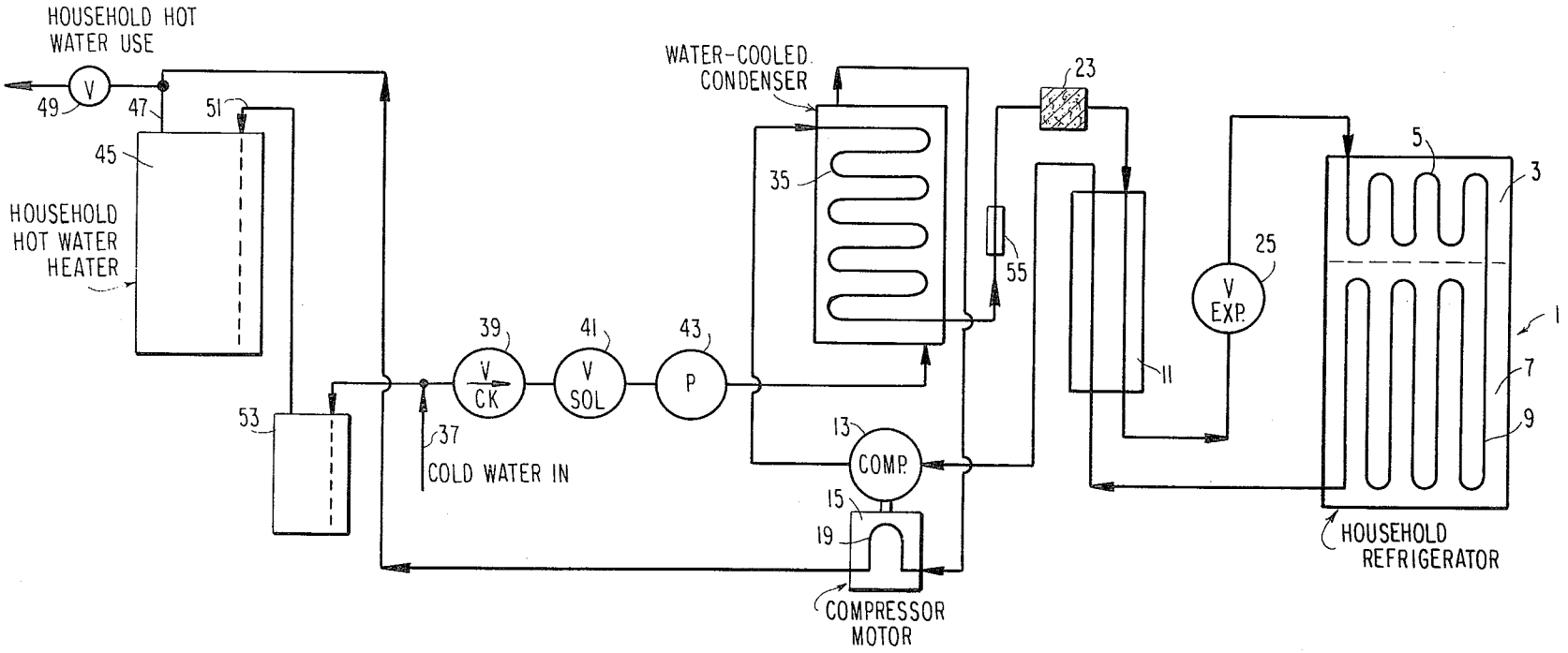
FIG. 3 is a fluid circuit diagram of an energy conservation system according to the present invention.

Referring now to the drawings in greater detail, and first to FIG. 1 thereof, there is shown a conventional household refrigerator 1 comprising a freezer compartment 3 having an evaporator 5 therein and a fresh food compartment 7 having an evaporator 9 therein. A refrigerant which can be any conventional refrigerant ordinarily used in household refrigerators, e.g. Freon R-12, flows in series through evaporators 5 and 9 and thence to a heat exchanger 11 in which it is used to cool high pressure refrigerant passing toward evaporator 5.

The low pressure refrigerant from heat exchanger 11, in vapor phase, then flows to a compressor 13 in which it is raised to the high pressure of the refrigeration cycle, compressor 13 being driven by a motor 15. From compressor 13, the compressed and heated refrigerant passes through an air-cooled condensing coil 17 and thence through a loop 19 in the base of the compressor motor which serves as an oil cooler.

From loop 19, the high pressure refrigerant in vapor phase flows to an air cooled condenser 21 in which it is at least partly condensed to liquid phase, and then through a filter-dryer 23 and heat exchanger 11 to expansion valve 25, from which the low pressure cold refrigerant, now all in liquid phase, returns to the evaporator 5.

FIG. 2 shows a fragment of the circuit diagram of the conventional household refrigerator that has just been described. From FIG. 2, it will be seen that a lamp 27 for the interior of the refrigerator is controlled by a refrigerator door switch 29. In parallel with lamp 27 and switch 29 is the compressor motor 15 which is actuated when a thermostat 31 that senses the interior temperature of the refrigerator, detects a sufficiently high temperature to require actuation of motor 15 and thus compressor 13. The circuit including motor 15 is protected by a conventional overload circuit breaker 33.

Thus far, the structure described, and its operation, can be entirely conventional and forms no part, as such, of the present invention.

Turning now to FIG. 3, there is shown the system of the present invention in comparison to FIG. 1. The same reference numerals are used in FIG. 3 to designate the parts that remain the same as in FIG. 1.

As will be seen from FIG. 3, the first change to be noted, relative to FIG. 1, is that air-cooled condenser 21 has now been replaced by a water-cooled condenser 35. Also, high pressure refrigerant from compressor 13 no longer passes through a condensing coil 17 and loop 19 of compressor motor 15, but now passes from compressor 13 directly to the refrigerant inlet at the hot end of condenser 35, and hence at a substantially higher temperature than in FIG. 1.

The water for condenser 35 enters from any household cold water inlet 37 and flows past check valve 39 toward a solenoid valve 41, which, when open, permits the flow of the water through pump 43 by which the water is impelled in the circuit to be described. From pump 43, the water flows to the cold end of condenser 35, in which it is subjected to indirect heat exchange with the refrigerant.

The water heated in condenser 35 now leaves condenser 35 and passes through loop 19 of the compressor motor, in which it is further heated. From loop 19, the hot water, at a temperature typically of about 120° F., flows to household hot water heater 45 of conventional construction. But the hot water enters heater 45 through the hot water inlet-outlet 47, from which hot water flows, on demand, to a household hot water use, such as a faucet, a dishwasher, a clothes washer, etc., represented by valve 49.

The water heated in condenser 35 and loop 19 is thus introduced at its characteristic temperature level in heater 45, namely, at the top thereof. When cold water must be drawn into heater 45, it enters, as is conventional, through the cold water inlet 51.

But as hot water can be produced in excess of that required, by the system of the present invention, there is the possibility that hot water from heater 45 will back up through the system toward and past condenser 35. To delay this, an auxiliary tank 53 is provided, through which cold water must pass during its travel from cold water inlet 37 to hot water heater 45, and through which, conversely, hot water must flow before it can back up in the system.

The outlet temperature of refrigerant cooled in water-cooled condenser 35 is monitored, as indicated diagrammatically by thermostat 55. When this refrigerant outlet temperature rises to a predetermined value, for example 150° F., then thermostat 55 opens solenoid valve 41 and actuates pump 43 to supply further cold water to condenser 35.

FIG. 4 shows the above function in the form of a simplified electrical circuit diagram. It will be noted, by comparison of FIG. 4 with FIG. 2, that FIG. 4 differs from FIG. 2 only by the addition of a further parallel connection in which is located thermostat 55 for the simultaneous actuation of solenoid valve 41 and pump 43 in parallel with each other.

It is to be noted that the purpose of monitoring the outlet temperature of the refrigerant at 55, is not so much to control that temperature as to control the outlet temperature of the water from condenser 35, so that its temperature level will be suitable for introduction into the top, that is, the hottest region of heater 45 and/or to ensure that the temperature of that heated water will be suitable for direct household use regardless of whether it passes through heater 45.

From a consideration of the foregoing disclosure, therefore it will be evident that all of the initially recited objects of the present invention have been achieved.

Although the present invention has been described and illustrated in connection with a preferred embodiment, it is to be understood that modifications and variations may be resorted to, without departing from the spirit of the invention, as those skilled in this art will readily understand. For example, although a separate heat exchanger 11 and expansion valve 25 have been shown, it will be recalled that a very common alternative, useful in the present invention, is to provide at this point a capillary-tube-type heat exchanger which serves also to throttle the refrigerant to the desired low pressure. Also, as an alternative to the provision of auxiliary tank 53, it is possible simply to provide a thermostatically actuated drain valve located on the cold water entrance to the existing hot water heater. In operation, when a given temperature was reached at this point, indicative of hot water backflow, the excess hot water would be dumped to a drain. These and other modifications and variations may be resorted to without departing from the spirit of the invention, as those skilled in this art will readily understand.

What is claimed is:

1. In a household having a household refrigerator and a household hot water heater, fed by a source of cold water, the refrigerator having a closed refrigeration cycle in which a refrigerant flows from a compressor to a condenser to an expander to at least one evaporator of the refrigerator and back to the compressor; the improvement comprising means to supply water from said cold water source to cool said condenser, means to feed water heated in said condenser to said hot water heater, and means to distribute water from said heater for household use, said compressor having a compressor motor having an oil cooling loop, said water passing from said condenser through said oil cooling loop and thence to said hot water heater and thence to household use.

2. Structure as claimed in claim 1, and means for introducing said water from said condenser into the top of said heater.

3. Structure as claimed in claim 1, and an auxiliary tank through which cold water must flow between the cold water source and the heater.

4. Structure as claimed in claim 1, and a check valve between the cold water source and the condenser to prevent the flow of water from the condenser inlet in a direction away from the condenser.

5. Structure as claimed in claim 1, and a solenoid valve and a pump between the cold water source and the condenser to cause water to flow toward the condenser.

6. Structure as claimed in claim 5, and means responsive to a pre-determined rise in temperature of the refrigerant leaving the condenser, to open said solenoid valve and actuate said pump.

7. Structure as claimed in claim 1, in which said refrigerant flows directly from said compressor to said condenser.

* * * * *